US005484957A

United States Patent [19]

Aoki et al.

[11] Patent Number: 5,484,957

[45] Date of Patent: Jan. 16, 1996

[54] AUTOMATIC ARRANGEMENT APPARATUS INCLUDING BACKING PART PRODUCTION

[75] Inventors: Eiichiro Aoki, Hamamatsu; Kazunori Maruyama, Tama, both of Japan

[73] Assignee: Yamaha Corporation, Japan

[21] Appl. No.: 215,790

[22] Filed: Mar. 22, 1994

[30] Foreign Application Priority Data

Mar. 23, 1993 [JP] Japan ..... 5-064340

[51] Int. Cl.[6] ..... G10H 1/38; G10H 1/40

[52] U.S. Cl. ..... 84/635; 84/637; 84/DIG. 12; 84/DIG. 22

[58] Field of Search ..... 84/609–614, 634–638, 84/649–652, 666–669, DIG. 12, DIG. 22

[56] References Cited

U.S. PATENT DOCUMENTS

| | | | |
|---|---|---|---|
| 4,267,762 | 5/1981 | Aoki et al. | 84/DIG. 22 |
| 4,381,689 | 5/1983 | Oya | 84/DIG. 22 |
| 4,619,176 | 10/1986 | Isii | 84/DIG. 12 |
| 4,748,885 | 6/1988 | Sato | 84/DIG. 12 |
| 4,882,964 | 11/1989 | Okamoto | 84/611 |
| 4,887,505 | 12/1989 | Suzuki | 84/DIG. 12 |
| 5,014,586 | 5/1991 | Sakashita | 84/637 |
| 5,179,240 | 1/1993 | Mizuno et al. | 84/613 |
| 5,300,726 | 5/1994 | Miyamoto | 84/611 |

*Primary Examiner*—Stanley J. Witkowski
*Attorney, Agent, or Firm*—Parkhurst, Wendel & Rossi

[57] ABSTRACT

In an automatic arrangement apparatus, a melody of a part of an original musical tune is memorized in a melody memory (4), chord data of the original musical tune is memorized in a chord progression memory (5), and a rhythm pattern in a rhythm pattern memory (12) is selected in accordance with the style and composition of the original musical tune. At a timing of a note code of the selected rhythm pattern, a top-note, an additional tone, a bass part and a drum part are produced. The top-note is produced by referring to a top-note table stored in a top-note table memory (15) and corresponds with the chord. The additional tone is produced in accordance with the top-note and the chord on a basis of a voicing table stored in a voicing table memory (16). The top-note and additional tone can be selected at a continuous two-tone pair.

4 Claims, 13 Drawing Sheets

Fig. 2

TOP-NOTE TABLE

TWO-TONE PAIR TABLE

| TP | TOP-NOTE |
|---|---|
| M | D♯→E |
| m | F♯→G |
| 7th | D♯→E |
| | F♯→G |
| ⋮ | ⋮ |

ONE-TONE PAIR TABLE

| TP | TOP-NOTE |
|---|---|
| M | D E G A B♭ |
| m | D E♭ G A B♭ |
| 7th | D E G A B♭ |
| ⋮ | ⋮ |

Fig. 3

VOICING TABLE

TWO-TONE PAIR TABLE

| TP | D | | SET NO. | ADDITIONAL TONE (1) | ADDITIONAL TONE (2) |
|---|---|---|---|---|---|
| M | 3 | D♯→E | 1 | −4, −8, −15 | −2, −7, −16, |
| | | | 2 | −4, −9, −15, −18 | −7, −14, −16, −18 |
| m | 6 | F♯→G | 1 | −4, −9, −11, −15 | −7, −10, −12, −16 |
| | | | 2 | −4, −9, −15, −18 | −7, −12, −6, −21 |
| ⋮ | ⋮ | ⋮ | ⋮ | ⋮ | ⋮ |

ONE-TONE PAIR TABLE

| TP | D | TOP-NOTE | SET NO. | ADDITIONAL TONE |
|---|---|---|---|---|
| M | 2 | D | 1 | −5, −7, −10, −14 |
| | | | 2 | −5, −10, −15, −19 |
| | 4 | E | 1 | −2, −7, −9, −16 |
| | | | 2 | −7, −14, −16, −21 |
| | ⋮ | ⋮ | ⋮ | ⋮ |
| m | ⋮ | ⋮ | ⋮ | ⋮ |
| ⋮ | ⋮ | ⋮ | ⋮ | ⋮ |

Fig. 4

CHORD PROGRESSION MEMORY

| |
|---|
| ROOT |
| TYPE |
| DURATION |
| ROOT |
| TYPE |
| ⋮ |
| END CODE |

Fig. 5 (A)

INPUT DISPLAY OF MUSICAL SENTENCE COMPOSITION

□ A—B—A'—B'

□ A—A—B—B

□ A—B—A'—B—A''

⋮

Fig. 5 (B)

INPUT DISPLAY OF MEASURE NUMBER

MUSICAL SENTENCE

| | A | B | A' | B' |
|---|---|---|---|---|
| | 2 | 2 | 2 | 2 |

MEASURE NUMBER

AUTOMATIC ARRANGEMENT APPARATUS INCLUDING BACKING PART PRODUCTION

BACKGROUND OF THE INVENTION

1. Field of the Invention

The present invention relates to an automatic arrangement apparatus for automatically producing performance data for a plurality of performance parts of an original musical tune when applied with a melody and chord progression of the original musical tune.

2. Description of the Prior Art

In U.S. Pat. No. 5,179,240 granted to Mizuno et al., there has been proposed an automatic arrangement apparatus which is designed to automatically produce performance data for other parts based on performance data of a melody part of an original musical tune. In the automatic arrangement apparatus, it is, however, difficult to produce a performance part optimal for the original musical tune. Although in the automatic arrangement apparatus, the performance data is produced on a basis of chords of the original musical tune, the produced performance data is simple and makes an unnatural impression on audience.

SUMMARY OF THE INVENTION

It is, therefore, a primary object of the present invention to provide an improved automatic arrangement apparatus capable of automatically producing performance data for a plurality of performance parts optimal for the original musical tune.

According to the present invention, the object is accomplished by providing an automatic arrangement apparatus which comprises input means for applying an information for arrangement of an original musical tune to a processing system of the arrangement apparatus, the information including at least a performance type information; memory means for memorizing a plurality of rhythm patterns which correspond with at least the performance type information, the rhythm patterns each representing a tone generation timing; selection means for selecting a desired rhythm pattern for arrangement of the original musical tune from the memorized rhythm patterns in accordance with the arrangement information applied thereto; means for supplying a pitch name information indicative of an available pitch for the original musical tune on basis of the arrangement information; means for reading out the selected rhythm pattern from said memory means; and means for producing a performance information based on the tone generation timing of the selected rhythm pattern and the pitch name information.

According to an aspect of the present invention, there is provided an automatic arrangement apparatus including means for supplying a chord information in an original musical tune to be arranged and means for producing performance data for plurality of parts of the original musical tune, which arrangement apparatus comprises first means for producing a first tone pitch information of a part of the original musical tune as a first performance information; and second means for producing a second tone pitch information of another part corresponding with the chord as a second performance information on a basis of the first tone pitch information.

According to another aspect of the present invention, there is provided an automatic arrangement apparatus wherein the first-named part of the original musical tune is a top-note part, and the second-named part is an additional tone applied to the top-note.

According to a further aspect of the present invention, there is provided an automatic arrangement apparatus which comprises first memory means for memorizing a rhythm pattern indicative of a tone generation timing in an original musical tune; supply means for supplying a tone pitch information in the original musical tune; second memory means for memorizing in sequence a plurality of informations each indicative of continuous tone pitch shorter than the rhythm pattern; selection means for selecting a set of continuous tone pitch informations from the memorized informations; and means arranged to be applied with the tone generation timing of the rhythm pattern, the tone pitch information and the selected set of continuous tone pitch informations respectively from said first memory means, said supply means and said second memory means for producing a performance information corresponding with the tone generation timing on a basis of the tone generation timing, the tone pitch information and the selected set of continuous tone pitch informations.

BRIEF DESCRIPTION OF THE DRAWINGS

Other objects, features and advantages of the present invention will be more readily appreciated from the following detailed description of a preferred embodiment thereof when considered with reference to the accompanying drawings, in which:

FIG. 2 illustrates a top-note table memorized in a top-note table memory shown in FIG. 1;

FIG. 3 illustrates a voicing table memorized in a voicing table memory shown in FIG. 1;

FIG. 4 illustrates a format of chord progression data memorized in a chord progression memory shown in FIG. 1;

FIG. 5(A) illustrates an input indication of a musical measure composition;

FIG. 5(B) illustrates an input indication of the number of measures;

DESCRIPTION OF THE PREFERRED EMBODIMENT

Figure 1:
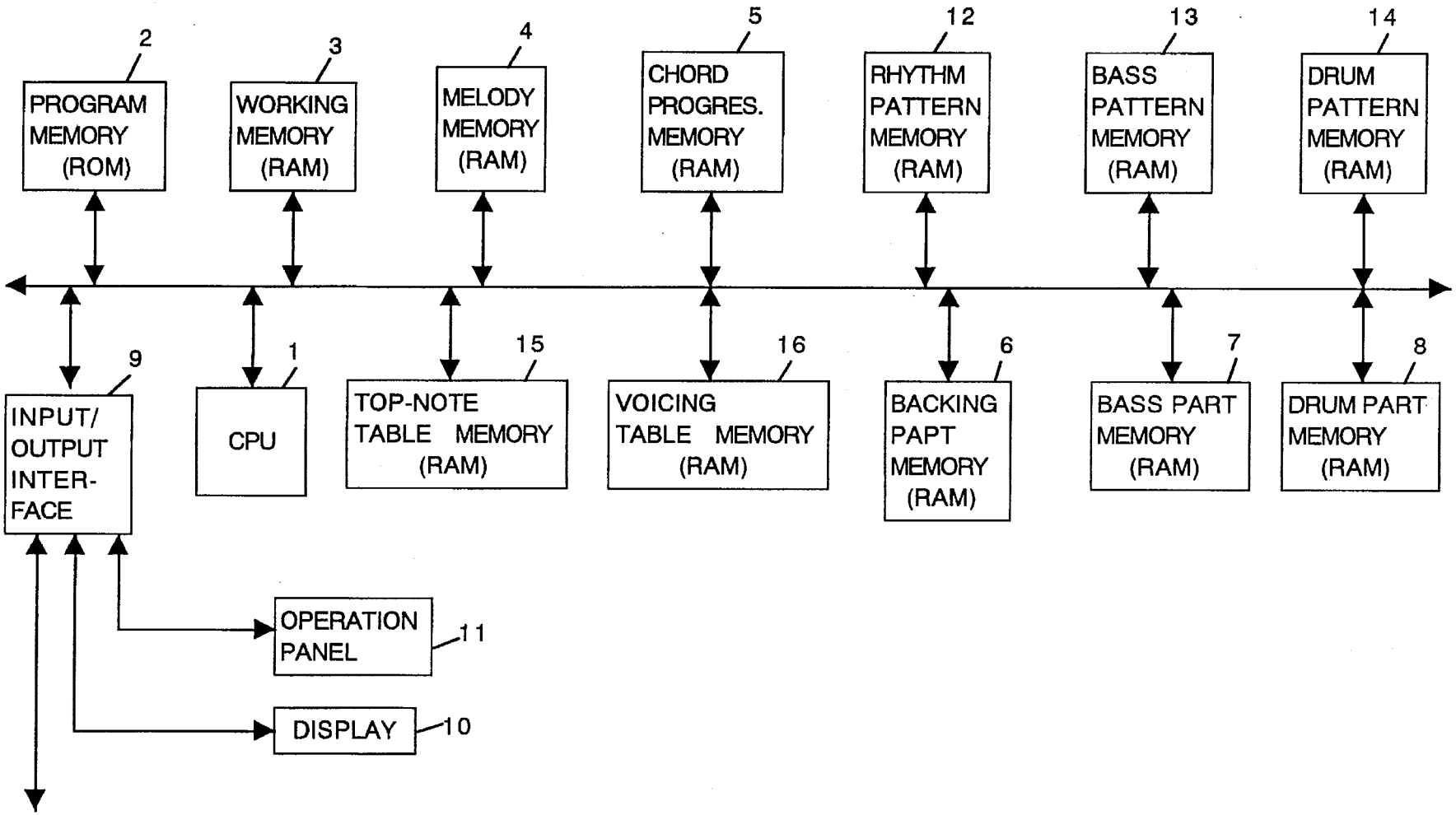
FIG. 1 is a block diagram of an automatic arrangement apparatus in accordance with the present invention.

In FIG. 1 of the drawings, there is schematically illustrated a block diagram of an automatic arrangement apparatus in accordance witch the present invention. The automatic arrangement apparatus includes a central processing unit or CPU 1 which is designed to use a working area of a working memory 3 for executing a control program stored in a program memory 2 in the form of a read-only memory or ROM. During execution of the control program, tile CPU 1 reads out performance data and chord progression data respectively memorized in a melody memory 4 and a chord progression memory 5 and is applied with the style of a musical tune and a musical sentence composition from an operation panel 10 through an input/output device 9 for producing performance data respectively for a backing part in a mid range of timbre of a guitar, a strings or the like, a bass part in a low range of timbre of a bass guitar, a tuba or the like and a drum part of timbre of a percussion instrument and for memorizing the performance data respectively in a backing part memory 6, a bass part memory 7 and a drum part memory 8. The timing and interval of notes in the performance data are defined by a predetermined clock value which causes, for instance, a quater note to correspond with twenty four (24) clocks.

The melody performance data and chord progression data are applied from an external equipment through the input/ouput device 9 and memorized in the melody memory 4 and the chord progression memory 5 respectively in the form of a predetermined format. For example, the chord progression data is memorized as shown in FIG. 4, wherein the root and the type of a chord are memorized with a duration data of the chord in sequence from the leading end of a musical tune, and an end code is memorized at the terminal end of the musical tune. The melody performance data is memorized, for example, as a set of a key-code of a melody and a timing data. The melody performance data and chord progression data may be directly applied to the memories 4 and 5 by performance of an operator or applied to the memories 4 and 5 from a previously prepared data file.

Figure 6:
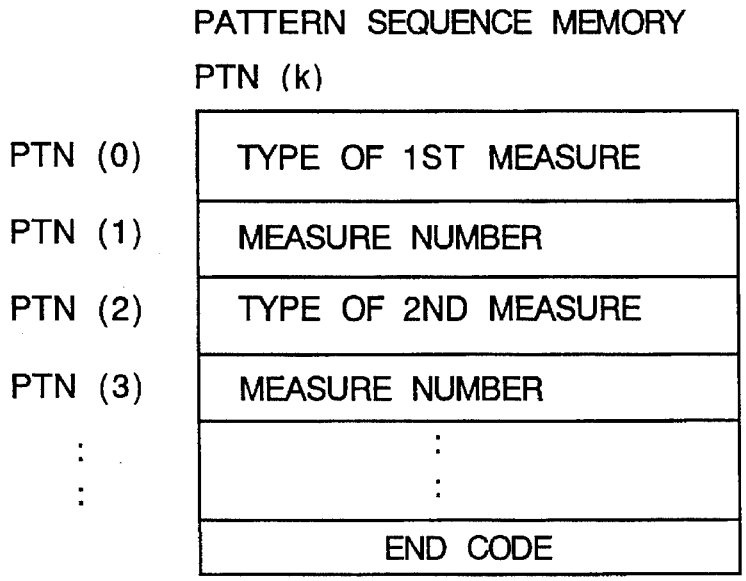
FIG. 6 illustrates a pattern sequence format memorized in a pattern sequence memory.

The style of the musical tune and the musical sentence composition are set by indication of a display portion 10 and operation of the operation panel 11 which are controlled by the operator's intention. The musical sentence composition is input as shown in FIGS. 5(A), 5(B), wherein tile musical sentence composition is indicated on the display portion 10 in the form of a combination of types (A-B-A'-B'; A-A-B-B'; . . . ) of the musical sentence as shown in FIG. 5(A). When the operation panel 11 is operated to select an appropriate musical sentence composition from the indicated musical sentence compositions, the indication of tile display portion 10 is switched over to indicate respective measure numbers of the selected sentence composition as shown in FIG. 5(B), and the indicated measure numbers are applied to a pattern sequence memory PTN(k) of the working memory 3 by operation of the operation panel 11. Thus, the selected musical sentence composition is memorized in the pattern sequence memory PTN(k) in the form of a format shown in FIG. 6, wherein the respective types of musical sentences and the measure number are memorized in sequence and an end code is memorized in the terminal end of the musical tune. In this instance, the types of musical sentences are memorized as type numbers. In addition, the style of the musical tune is indicated as a style name on the display 10 and selected by operation of the operation panel 11. Thus, the style of the musical tune is memorized as a style number.

Figure 7:
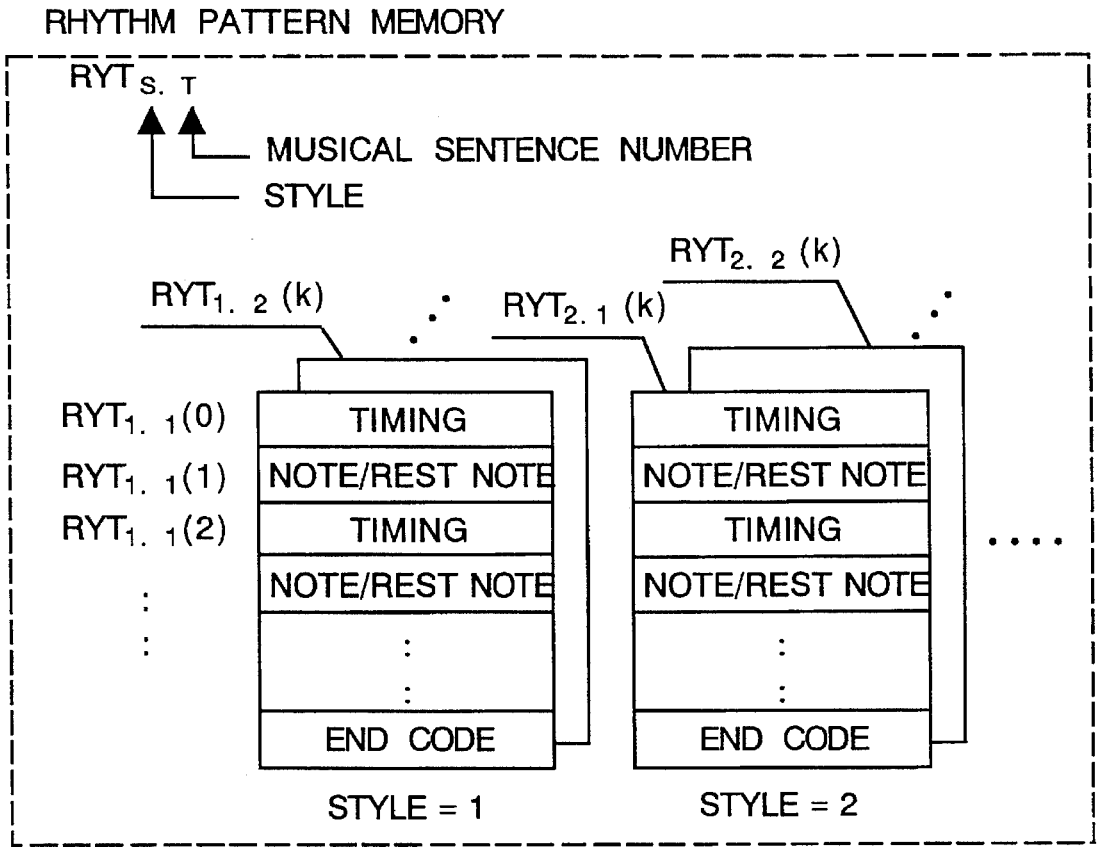
FIG. 7 illustrates a rhythm pattern format memorized in a rhythm pattern memory shown in FIG. 1.
Figure 8:
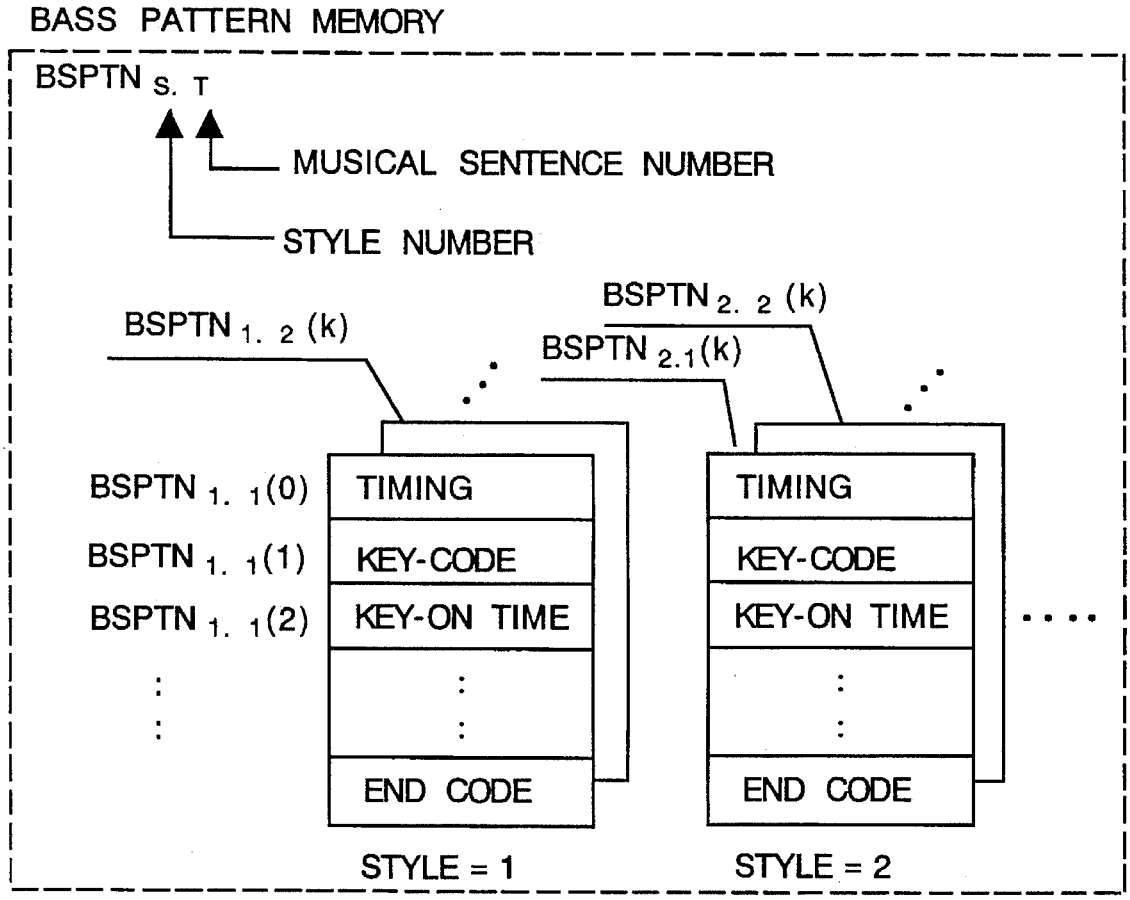
FIG. 8 illustrates a bass; pattern format memorized in a bass pattern memory shown in FIG. 1.

As shown in FIG. 1, the automatic arrangement apparatus includes a rhythm pattern memory 12 and a bass pattern memory 13. As shown in FIG. 7, the rhythm pattern memory 12 is arranged to memorize plural kinds of rhythm pattern data which correspond with the types of the musical sentence. The rhythm pattern data each includes plural sets of a timing data and a note code or a rest-note code for one measure and an end code memorized at the terminal end of the measure. The rhythm pattern data is applied to the CPU 1 in accordance with the style number S and the type number T of the musical sentence so that a key-code of the backing part is produced as performance data at the timing defined by the note code. As shown in FIG. 8, the bass pattern memory 13 is arranged to memorize plural kinds of bass pattern data which correspond with the style and type of the musical sentences. The bass pattern data each includes plural sets of a timing data, a key-code of a bass tone and a key-on time for one measure and an end code memorized at the terminal end of the measure. In addition, the key-code of the bass tone is memorized, for example, in the form of C Major code, and the bass pattern data is applied to the CPU 1 in accordance with the style number S and the type number T of the measures. Thus, the bass tone at a current timing is converted in pitch in accordance with a current data of the chord to produce the key-code of the bass part pattern data as performance data.

In this embodiment, the rhythm pattern data is adapted as a timing data which does not include any tone pitch data. It is, however, apparent that velocity data may be added to the timing data. Although in some technical report the term of a performance pattern of a percussion equipment is used to represent a rhythm pattern, such a performance pattern is expressed by the term of a drum pattern or drum part in this embodiment. In addition, the drum pattern memory 14 is arranged to memorize plural kinds of drum pattern data for one measure. Thus, an appropriate drum pattern is selected from the drum pattern data in accordance with the style number S and the type number T of the measures and is memorized as performance data of a drum part in a drum part memory 8.

Figure 9:
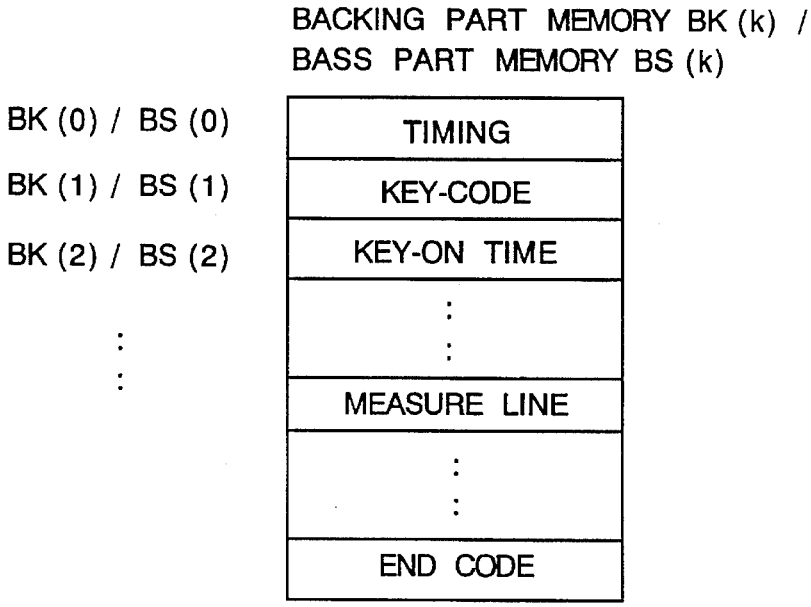
FIG. 9 illustrates a backing part format and a bass part format respectively memorized in a backing part memory and a bass part memory shown in FIG. 1.

The respective key-codes of the backing part and the bass part are memorized in the backing part memory 6 and the bass part memory 7 in the form of a format shown in FIG. 9, wherein plural sets of a timing data, a key-code and a key-on time are memorized in such a manner as to memorize a measure line between respective measures, and wherein an end code is memorized at the terminal end of the musical tune. In the drum part memory 8, the drum pattern data is also memorized in such a manner as to memorize a measure line between the respective measures. In this embodiment, the key-code of the bass part is converted in tone pitch in accordance with the chord to produce a bass tone of the bass pattern memory 13, the key-code of the backing part is used to produce a top-note in accordance with the chord in reference to a top-note table in a top-note table memory 15, and an additional tone is produced in accordance with the chord and the top-note in reference to a voicing table in a voicing table memory 16.

In case the performance data of the melody memory 4 includes a current melody tone during production of the top-note, a candidate tone nearest to the current melody tone is produced as the top-note in accordance with the chord. In case there is not any current melody tone, a candidate tone is selected in random in accordance with the chord and produced as the top-note. The production of the top-note is further conducted to produce a top-note of one-tone corresponding with a timing measure of the rhythm pattern and to produce a top-note of a two-tone pair corresponding with two continuous timing measures.

As shown in FIG. 2, the top-note table is composed of a two-tone pair table for producing a top-note of a two-tone pair and a one-tone table for producing a top-note of one-tone. In the respective tables, candidate tones of the top-note (D#-E, F#-G, . . . ; D-E-G-A-Bb, D-Eb-G-A-Bb, . . . ) are memorized in such a manner as to correspond with the type of the chord TP(M, m, 7th . . . ). In this embodiment, candidate tones related to chords ("C", "Cm", "C7th" . . . ) of the root "C" are memorized as pitch name codes. A pitch name code selected from the candidate tones is converted in pitch on a basis of the root of the chord and memorized as a key-code of a top-note corresponding with the respective chords.

As shown in FIG. 3, the voicing table is composed of a two-tone pair table for producing two sets of additional tones 1 and 2 corresponding with the top-note of the two-tone pair and a one tone table for producing a set of additional tones correspond with the top-note of the one-tone. In the respective tables, additional tone candidates corresponding with a combination of the type of chord and the candidate of the top-note are memorized by two sets of additional data indicative of differences in tone pitch from the top-note ("-4", "-8", . . . ) to be selected by a set number (No.). In the voicing table, No. 1 of the set number corresponds with a closed chord or closed voicing, and No. 2 of the same corresponds with an open chord or open voicing. For referring to the top-note, a difference D in tone pitch between the top-note and the root of chord (C) is additionally listed. In addition, the tone pitch difference D and the additional tone each correspond with a half note in one difference.

Figure 10:
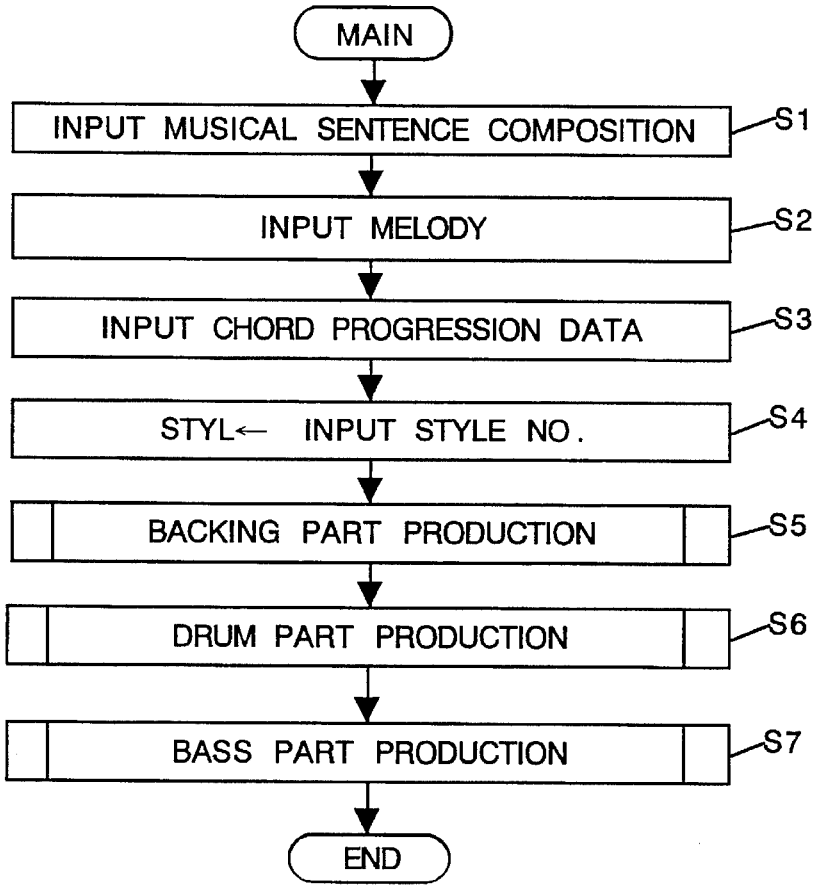
FIG. 10 is a flow chart of a main routine of a control program.

A flow chart of a main routine of the control program is illustrated in FIG. 10, and flow charts of sub-routines of the control program are illustrated in FIGS. 11 to 18. Hereinafter, operation of the automatic arrangement apparatus will be described in detail with reference to these flow charts. In the following description, respective registers and pointers of the backing part memory 6, bass part memory 7, bass pattern memory 13, additional tone data or key codes and the like are represented as listed below.

$AD_1$ (j): Additional tone data or key-code of the first additional tone 1

$AD_2$ (j): Additional tone data or key-code of the second additional tone 2

BK(k): Register of the backing part memory 6

BKP: Writing pointer of the backing part memory 6

BP: Read-out pointer of the bass pattern memory 13

BS(k): Register of the bass part memory 7

BSP: Writing pointer of the bass part memory 7

$BSPTN_{S,T}$ (k): Register of the bass pattern memory 13 corresponding with the style number S and the type number T of measures BTMm: Minimum value (Bottom tone) (m=1, 2) of additional tone data or key-code of No. m of the set number BYMKC: Key-code of a bottom tone of produced additional tone D: Tone pitch difference of the top-note and the root of a chord GTM: Gate-time (Key-on time) of the rhythm pattern i: Selection number K: Counter of the number of additional tones KC: Key-code of the bass part MJN: Counter of the measure number in a musical sentence of the pattern sequence memory NC: Pitch name code of a top-note of one-tone NC1: Pitch name code of a previous tone in a top-note of a two-tone pair NC2: Pitch name of the following tone in the top-note of the two tone pair n: Number of top-notes of one-tone or two-tone pair (One-tone: n=1, Two-tone pair: n=2)

ORT: Root of a previous chord

OTP: Type of the previous chord

PTN(k): Register of the pattern sequence memory

PTNP: Read-out pointer of the pattern sequence memory

RT: Root of a chord $RYT_{S,T}$(k): Register corresponding with the style number S and the type number T of musical sentences in the rhythm pattern memory 12

RYTP: Read-out pointer of the rhythm pattern memory 12

S: Applied style number

STYL: Applied type number

T: Type number of musical sentences in the pattern sequence memory

TKC: Key-code of a melody in performance data of the melody memory 4

TP: Type of a chord

TPKC: Key-code of a top-note of produced one-tone

TPKCm: Key-code of a top-note of produced two-tone pair (m=1: Previous tone, m=2: Following tone)

Assuming that the automatic arrangement apparatus has been connected to an electric power source, the CPU 1 is activated to initiate execution of the main routine of the control program shown in FIG. 10. As step S1 of the main routine, the CPU I reads out a musical sentence composition in such a manner as previously described with reference to FIG. 5. At the following step S2, the CPU 1 is applied with a melody from the external equipment through the input/output interface 9 and causes the program to proceed to step S3 where the CPU I is applied with chord progression data from the external equipment through the input/output interface 9. Subsequently, the CPU i is applied with at step S4 a style number S from the external equipment to memorize the style number S as STYL in the working memory 3. Thereafter, the CPU 1 executes at step S5 processing of a backing part production routine shown in FIG. 11 and executes at step S6 processing of a drum part production routine shown in FIG. 17. The CPU 1 further executes at step S7 processing of a bass part production routine shown in FIG. 18 and terminates the execution of the main routine of the control program.

Figure 11:
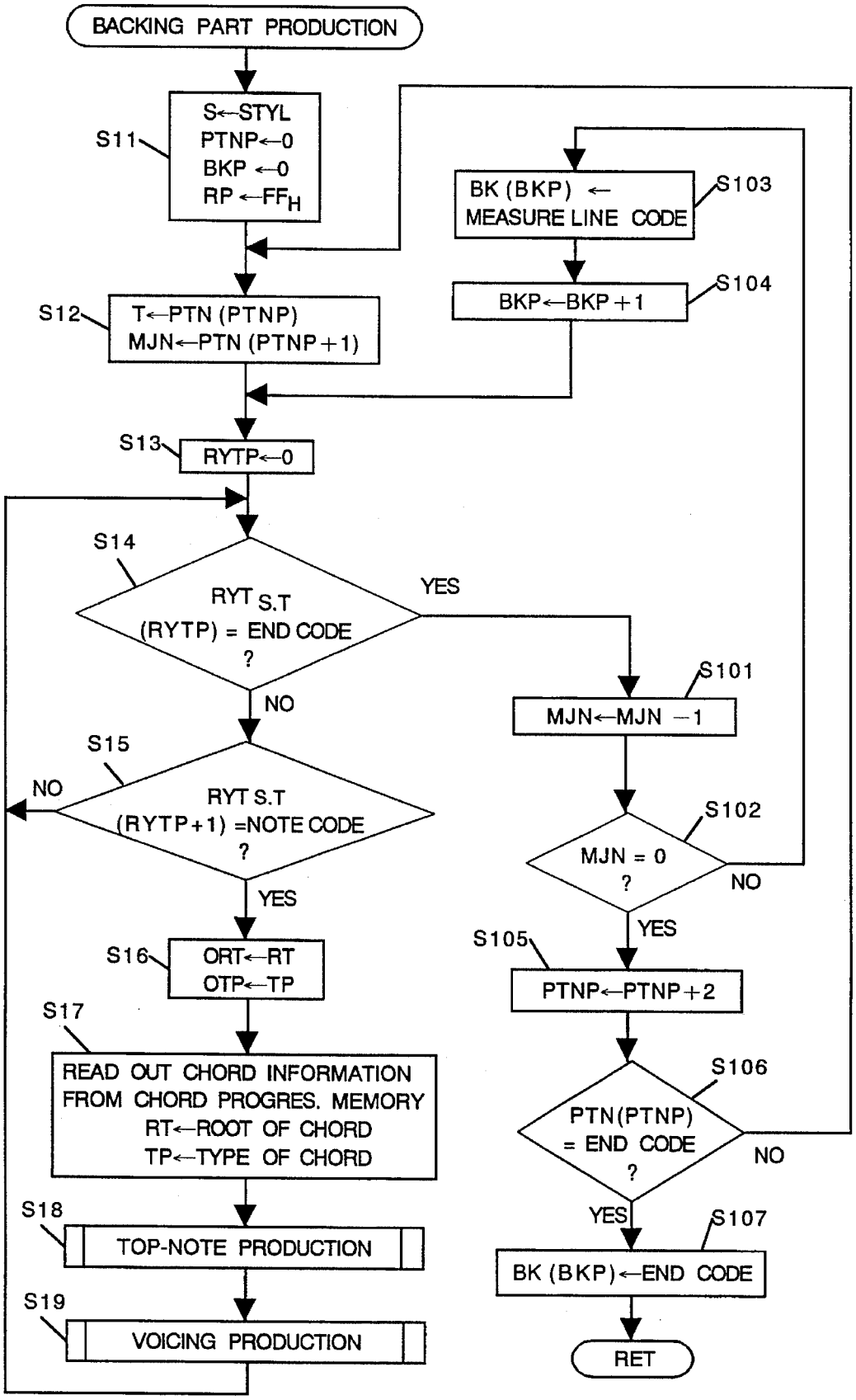
FIG. 11 is a flow chart of a backing part production routine.

During execution of the backing part production routine shown in FIG. 11, the CPU 1 reads out the pattern data from the rhythm pattern memory 12 with reference to the type of a musical sentence and style of the same stored in the pattern sequence memory. Thus, the CPU 1 produces a top-note and an additional tone in accordance with the content of the melody memory 4 and chord progression memory 5 and memorizes the produced top-note and additional tone in the backing part memory 6 in the form of the format shown in FIG. 9. When detected the end code of the musical sentence in the rhythm pad, tern memory 12, the CPU 1 terminates processing of the musical sentence and memorizes a measure line code in the backing part memory 6. Subsequently, the CPU 1 repeats processing of the following measures at each type of the musical sentences and terminates the processing of the musical sentences when detected the end code stored in the pattern sequence memory.

That is to say, at step S11 shown in FIG. 11, the CPU 1 sets the style number STYL as a number S, resets the pointer PTNP of the pattern sequence memory and the pointer BKP of backing part memory 6 and sets the root of the chord RT as a defort value "$FF_H$". When the program proceeds to step S12, the CPU 1 sets the data of the registers PTN(PTNP), PTN(PTNP+1) of the pattern sequence memory respectively as the type number T of a musical sentence and the number MJN of measures for processing at the following step. The processing at step S12 is repeated to renew the type number T and the number MJN of measures until an end code of the pattern sequence memory is detected at step 106. When the end code of the pattern sequence memory is detected at step S106, the program proceeds to step S107 where the CPU 1 memorizes the end code in the backing part memory 6 and terminates the processing for producing the backing part.

For processing the respective musical sentences, the CPU 1 resets the pointer RYTP of rhythm pattern memory 12 at step S13 and executes processing for one measure at step S14 to S19. In this instance, the pointer RYTP of rhythm pattern memory 12 is increased with "2" by each processing of the voicing routine described later. Thus, as shown in FIG. 7, the data of the register $RYT_{S,T}$(RYTP) of rhythm pattern memory 12 is set as a timing data or an end code. Accordingly, the CPU 1 determines at step S14 whether the data of the register $RYT_{S,T}$ (RYTP) is the end code or not and repeats processing for the one measure at step S15 to S19. When the data of the register $RYT_{S,T}$ (RYTP) becomes the end code, the CPU 1 determines a "Yes" answer at step S14 and causes the program to proceed to step S101.

At step S15, the CPU 1 determines whether the data of the register $RYT_{S,T}$ (RYTP+1) is a note code or not. If the answer at step S15 is "No", the CPU 1 returns the program to step S14. If the answer at step S15 is "Yes", the CPU 1 sets at step S16 the root and the type of the chord RT, TP respectively as the root and the type of a previous chord ORT, OTP. At the following step S17, the CPU 1 reads out a chord data corresponding with the data of the register $RYT_{S,T}$ (RYTP) from the chord progression memory 5 and sets the chord data as the root and the type of the chord RT, PT. Subsequently, the CPU 1 executes at step S18 the top-note production routine for producing a top-note and executes at step S19 the voicing routine for producing an additional tone. After execution of the voicing routine, the program returns to step S14.

When the processing for the one measure has finished, the program proceeds to step S101 where the CPU 1 subtracts "1" from the number MJN of measures and causes the program to proceed to step S102. At step S102, the CPU 1 determines whether the number MJN of measures is "0" or not. Thus, the CPU 1 repeats the processing at step S103, 104 and step S13 to S19 until the remaining number of measures for the musical sentence becomes "0". In addition, the CPU 1 memorizes at step S103 a measure line code in the register BK(BKP) backing part memory 6 upon termination of the one measure and renews the data of the pointer BKP of backing part memory 6 by increment of "1".

Figure 12:
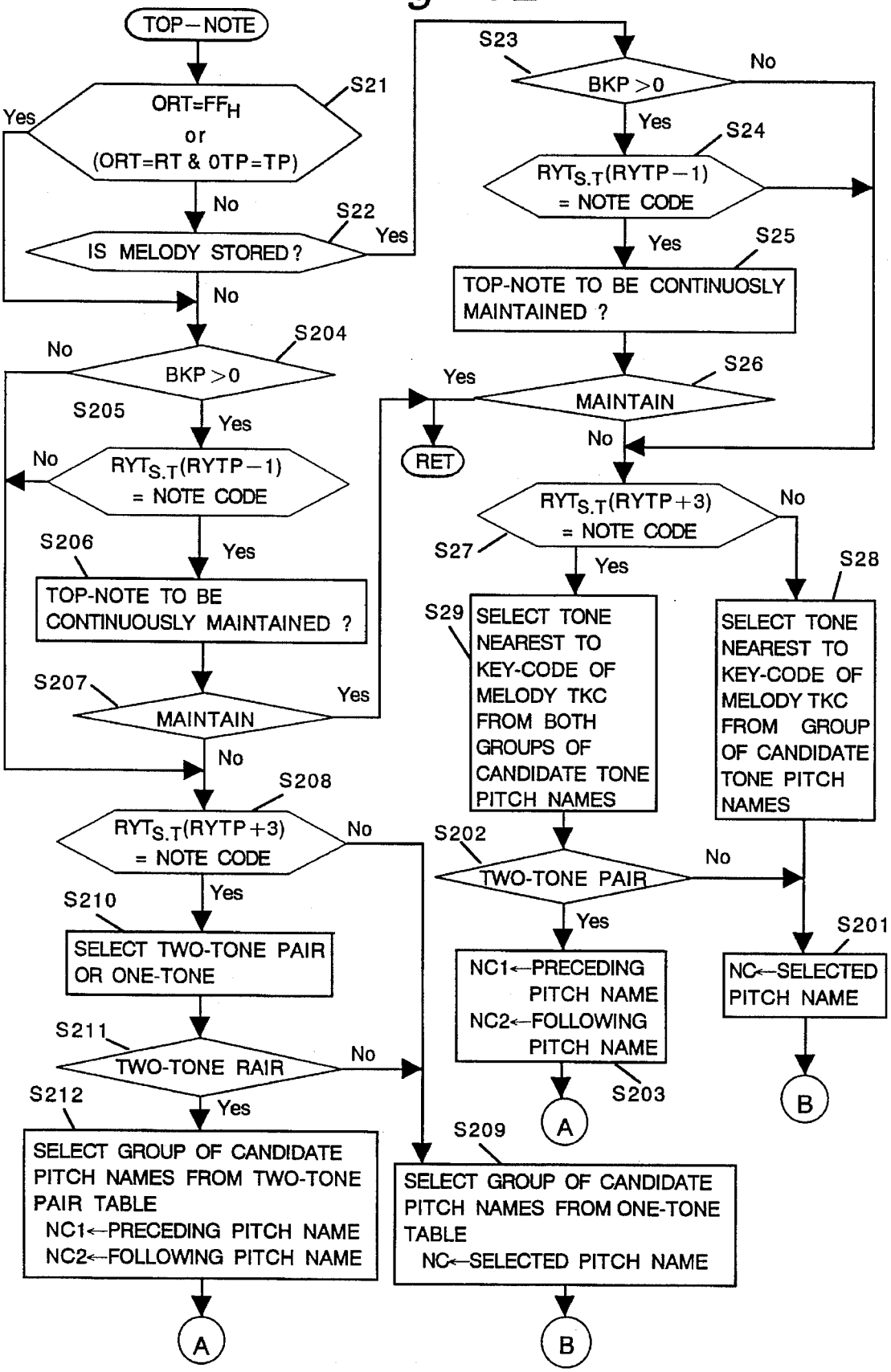
FIG. 12 is a flow chart of a top-note production routine.

During execution of the top-note production routine shown in FIG. 12, the CPU 1 determines at step S21 whether a current chord RT corresponding with a timing of a current note code has changed from a previous chord or not. If the answer at step S21 1s "Yes", the program proceeds to step S204 where the CPU I determines whether the writing pointer BKP of backing part memory 6 is more than "0" or not. If the answer at step S21 is "No", the program proceeds to step S22 where the CPU 1 determines whether or not a melody is being stored in the melody memory 4 during a duration time of the current chord. If the answer at step S22 is "Yes", the CPU 1 causes the program to proceed to step S23 for executing processing based on a key-code TKC of the melody and the top-note table at the following step. If the answer at step S22 is "No", the CPU 1 causes the program to proceed to step 204 for executing processing based on the top-note table.

When the writing pointer BKP of backing part memory 6 is less than "0", the CPU 1 determines a "No" answer at step S23 and causes the program to proceed to step S27 for producing a first top-note by processing at the following step. If the answer at step S23 is "Yes", the program proceeds to step S24 where the CPU 1 determines whether or not a note code is being stored in the register $RYT_{S,T}$(RYTP−1) of rhythm pattern memory 12 or whether or not pattern data of a previous timing of the current chord is a note code in the rhythm pattern of rhythm pattern memory 12. If the answer at step S24 is "No", the CPU 1 causes the program to proceed to step S27. If the answer at step S24 is "Yes", the program proceeds to step S25 where the CPU 1 determines as to whether or not a previously produced top-note is to be continuously maintained. In the event that it has been determined to continuously maintain the previously produced top-note, the CPU 1 returns the program to the main routine at step S26. In the event that the maintenance of the previously produced top note is not required, the CPU 1 causes the program to proceed to step S27 for producing a fresh top-note by processing at the following step.

At step S27, the CPU 1 determines whether or not a note code is being stored in the register $RYT_{S,T}$ (RYTP+3) of rhythm pattern memory 12 or whether or not pattern data of the following timing of the current note code is a note code.. If the answer at step S27 is "No", the program proceeds to step S28 where the CPU 1 selects a top-note based on the one-tone table. If the answer at step S27 is "Yes", the program proceeds to step S29 where the CPU 1 selects a top-note based on the one-tone table and the two-tone pair table. Accordingly, in processing at step S28, the CPU 1 selects a group of candidate pitch names from the one-tone table of the top-note table in accordance with the type of the current chord TP and selects a tone nearest to the key-code of the melody from the group of candidate tone pitch names in a predetermined tone area during the duration time of the current chord when the root of the chord has shifted in pitch. Thus, the CPU I sets at step S201 the pitch name code of the selected tone as a pitch name of the fresh top-note and causes the program to proceed to step S220 shown in FIG. 14. In processing at step S29, the CPU 1 selects a group of pitch names of the previous tone from the two-tone pair table of the top note table in accordance with the type of the current chord TP and selects a group of candidate pitch names from the one-tone table of the top note table in accordance with the type of the current chord TP thereby to select a tone nearest to the key-code of melody TKC from both the groups of pitch names in a predetermined tone area when the root of the current chord has shifted.

When the program proceeds to step S202, the CPU 1 determines whether or not the selected tone has been selected from the two-tone pair table. If the selected tone has been selected from the one-tone table, the program proceeds to step S201 where the CPU 1 memorizes the selected tone as the pitch name code of the previous tone. If the selected tone has been selected from the two-tone pair table, the program proceeds to step S203 where the CPU 1 sets the pitch name of the previous tone as a pitch name code NC1 and sets the pitch of the following tone as a pitch name code NC2 and causes the program to proceed to step S213.

When the program proceeds to step S204 by determination at step S22, the CPU 1 executes the same processing as those at step S24 to S26 at step S205 to S207 to determine whether or not a previously produced top-note is to be continuously maintained. In the event that it has been determined to continuously maintain the previously produced top note, the CPU 1 returns the program to the main routine at step S207. In the event that the maintenance of the previously produced top-note is not required, the program proceeds to step S208 where the CPU 1 determines whether or not a note chord is being stored in the register $RYT_{S,T}$ (RYTP+3) of the rhythm pattern memory 12 or whether the following pattern data is a note code or not. If the answer at step S208 is "No", the program proceeds to step S209 where the CPU 1 selects a group of candidate pitch names from the one-tone table of the top-note table in accordance with the type of the chord TP and selects a pitch name in random from the group of candidate pitch names to thereby set the selected pitch name as a pitch name code NC. In turn, the program proceeds to step S220 shown in FIG. 14. If the answer at step 208 is "Yes", the program proceeds to step S210 where the CPU 1 selects in random either a two-tone pair or one-tone. If the one-tone is selected at step S210, the CPU 1 determines a "No" answer at step S211 and causes the program to proceed to step S209. If the two-tone pair is selected at step S210, the CPU 1 determines a "Yes" answer at step S211 and causes the program to proceed to step S212 where the CPU 1 selects a group of candidate pitch names from the two-tone pair table in accordance with the type of the chord TP and selects a set of two-tone pairs in random from the group of candidate pitch names to thereby set a pitch name code of a previous tone of the selected set of two-tone pairs as a pitch name code NC1 and set a pitch name code of the following tone as a pitch name code NC2. In turn, the program proceeds to step S213 shown in FIG. 13.

Figure 13:
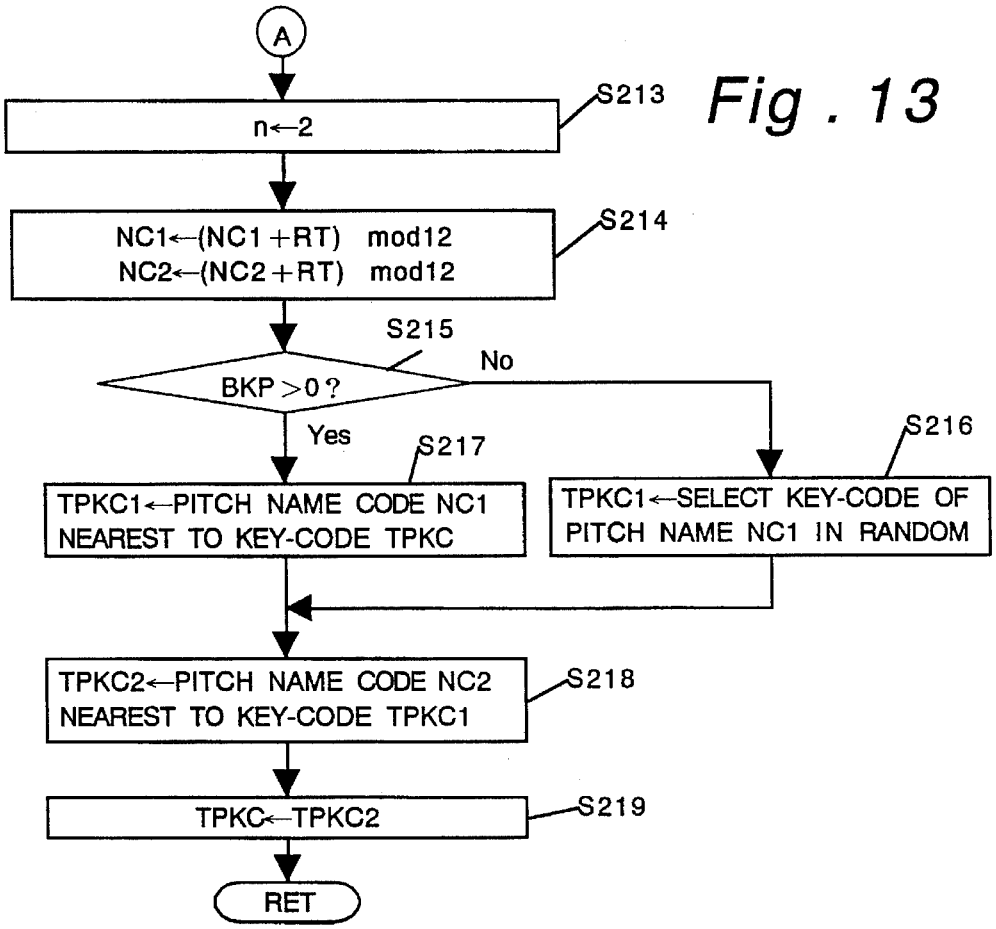
FIG. 13 is a flow chart illustrating a first remaining portion of the top-note production routine.

When the program proceeds to step S213 shown in FIG. 13, the CPU 1 sets the number "n" of the two-tone pair as "2" and causes the program to proceed to step S214. Thus, the CPU 1 converts at step S214 the pitch name codes NC1, NC2 into the pitch name codes of the current chord based on the root of the chord RT and determines at step S215 whether or not the writing pointer BKP of backing part memory 6 is more than "0" or whether or not a first top note is produced. If the answer at step S215 is "No", the program proceeds to step S216 where the CPU 1 selects a key-code of pitch name NC1 in random in a predetermined tone area and sets the selected key-code as a key-code TPKC1 of a previous top-note. After processing at step S216, the program proceeds to step S218. If the answer at step S215 is "Yes", the program proceeds to step S217 where the CPU 1 sets a pitch name code NC1 nearest to the key-code TPCK of the previous top-note in the predetermined tone area as a key-code TPCK1 of the previous top-note and causes the program to proceed to step S218. At step S218, the CPU 1 sets a pitch name code NC2 nearest to the key-code TPKC1 of the previous top-note in the predetermined tone area as a key-code TPKC2 of the following top-note. Subsequently, the CPU 1 sets at step S219 the key-code TPKC2 of the following top note as a key-code TPKC of a preceding top-note in the following processing and returns the program to the main routine.

Figure 14:
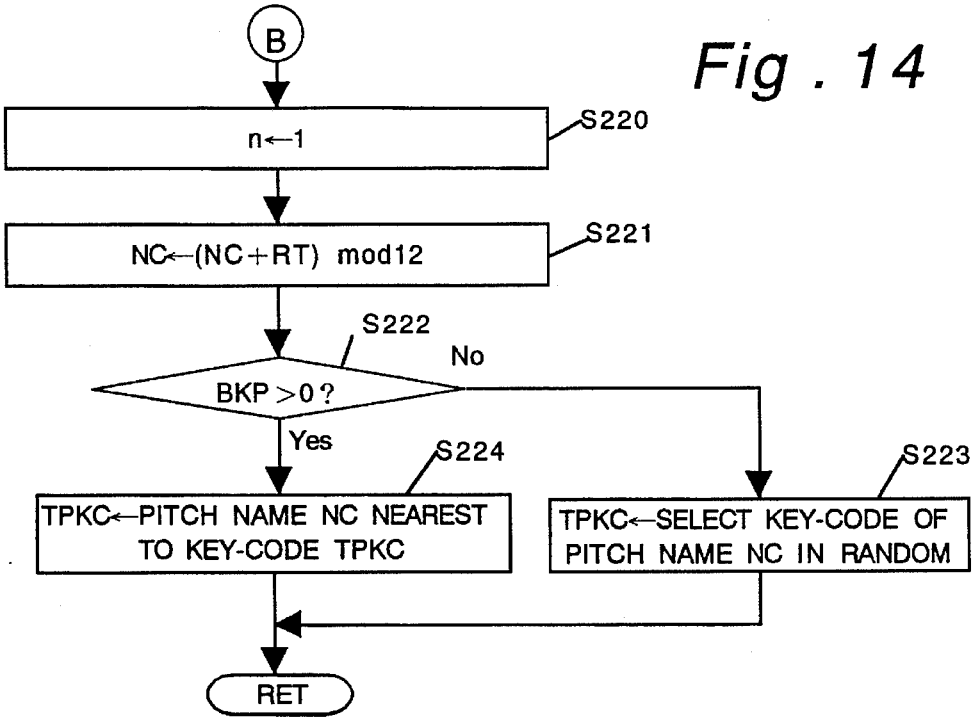
FIG. 14 is a flow chart illustrating a second remaining portion of the top note production routine.

When the program proceeds to step S220 shown in FIG. 14, the CPU 1 sets the number "n" of the one-tone as "1" and causes the program to proceed to step S221 where the CPU 1 converts the pitch name code NC into a pitch name code of the current chord based on the root of the chord RT. At the following step S222, the CPU 1 determines whether or not the writing pointer of backing part memory 6 is more than "0". If the answer at step S222 is "No", the program proceeds to step S223 where the CPU 1 selects a key-code of pitch name NC in random in a predetermined tone area to set the selected key-code as a key-code TPKC of a first top-note and returns the program to the main routine. If the answer at step S222 is "Yes", the program proceeds to step S224 where the CPU 1 sets a pitch name code NC nearest to the key-code TPKC of the previous top-note in the predetermined tone area as a key-code TPKC of a second top-note and returns the program to the main routine.

With the foregoing processing of the top-note production routine, a top-note of the two-tone pair or one-tone is produced. When top-notes of the two-tone pair have been produced, the key-code of a previous top-note is set as a key-code TPKC1 and the key-code of the following top-note is set as a key-code TPKC2. When a top-note of the one-tone has been produced, the key-code of the top-note is set as a key-code TPKC, and a key-code of a preceding top-not in the following processing is set as a key-code TPKC.

Figure 15:
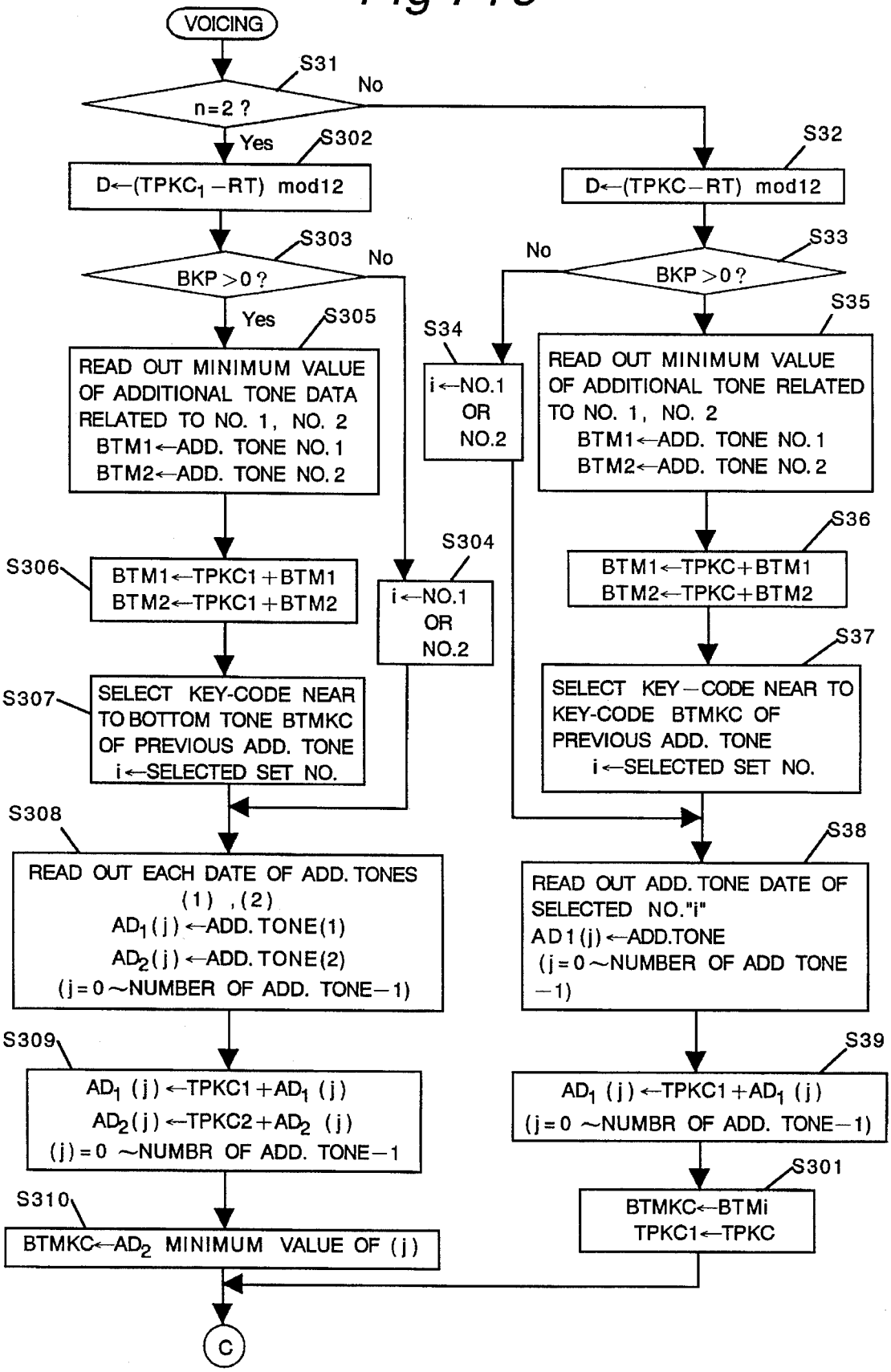
FIG. 15 is a flow chart of a voicing routine.

During execution of the voicing routine shown in FIG. 15, a harmony tone or an additional tone is added to the produced top-note. In this processing, the additional tone is added to the produced top-note taking into account of connection of its bottom tone to the top-note without causing unnatural sudden change of its tone area. When the program proceeds to step S31, the CPU 1 determines whether the number "n" of the one-tone or the two-tone pair is "2" or not. In case a top-note of the one-tone has been produced, the CPU 1 determines a "No" answer at step S31 and causes the program to proceed to step S32 for producing an additional tone according to the one-tone by processing at the following step. In case a top-note of the two-tone pair has been produced, the CPU 1 determines a "Yes" answer at step S31 and causes the program to proceed to step S302 for producing an additional tone according to the two-tone pair by processing at the following step.

Assuming that the program has proceeded to step S32, the CPU 1 sets a difference in tone pitch between the key-code TPKC1 of the previous top-note and the root of the chord RT as a tone pitch difference D and determines at step S33 whether the writing pointer BKP of backing part memory 6 is more than "0" or not. If the answer at step S33 is "No", the program proceeds to step S34 where the CPU 1 selects in random either No. 1 or No. 2 of the voicing table for the one-tone to set the selected number as a selection number "i" and causes the program to proceed to step S38. If the answer at step S33 is "Yes", the program proceeds to step S35 where the CPU 1 reads out a minimum value or a maximum absolute value of an additional tone related to No. 1 and No. 2 in accordance with the type of the chord TP and the tone pitch difference D applied from the voicing table for the one-tone and sets the additional tone data of No. 1 as a minimum value BTM 1 and the additional tone data of No. 2 as a minimum value BTM 2. Thus, a candidate tone of the bottom tone is selected from No. 1 and No. 2. At the following step S36, the CPU 1 adds the additional tone data BTM 1 and BTM 2 respectively to the key-codes TPKC of the top-note and converts a resultant of the addition into a key-code of an absolute tone pitch of the additional tone. Thus, the CPU 1 sets the key-code of the additional tone of No. 1 as a minimum value BTM 1 and the key-code of the additional tone of No. 2 as a minimum value BTM 2. When the program proceeds to step S37, the CPU 1 selects a key-code (a lower key-code in the same interval) near to the key-code BTMKC of the previous additional tone from the minimum values BTM 1 and BTM 2 to set the number "i" of the selected key-code and causes the program to proceed to step S38. As a result, a closed chord or an open chord is determined by the bottom tone without causing a large difference in tone pitch relative to the previous bottom tone.

As the following step S38, the CPU 1 reads out the additional tone data of the selected number "i" from the voicing table of the one-tone in accordance with the type of the chord TP and the tone pitch difference D and sets the additional tone data as an additional tone data $AD_1(j)$ (j=0 to the number of additional tones–1) in sequence. Subsequently, the CPU 1 adds at step S39 the additional tone data $AD_1$ (j) to the key-code TPKC of the top-note to rewrite the key-code of the additional tone of the selected number "i" with the additional tone data $AD_1$ (j) in sequence and determines a voicing (a combination of tone pitch for use) of the backing part for five (5) tones to four (4) tones of from the top-note to the bottom-tone. When the program proceeds to step S301, the CPU 1 sets the key-code BTMi of the additional tone of the selected number "i" as an additional tone BTMKC of a previous bottom tone in the following processing and sets the key-code TPKC of the top note as a key-code TPKC1. Thereafter, the program proceeds to step S311 shown in FIG. 16.

Assuming that the program has proceeded to step S302, the CPU 1 sets a difference between the key-code TPKC1 of the previous top-note and the root of the chord RT as a tone pitch difference D and causes the program to proceed to step S303 where the CPU 1 determines whether or not the writing pointer BKP of the backing part memory 6 is more than "0". If the answer at step S303 is "No", the program proceeds to step S304 where the CPU 1 selects in random either No. 1 or No. 2 of the voicing table for the two-tone pair to set the selected number "i" and causes the program to proceed to step S308. If the answer at step S303 is "Yes", the program proceeds to step S305 where the CPU 1 reads out a minimum value of the additional tone data related to No. 1 and No. 2 from the voicing table for the two-tone pair in accordance with the type of the chord TP and the tone pitch difference D and sets the additional tone data of No. 1 as a minimum value BTM 1 and the additional tone data of No. 2 as a minimum value BTM 2. Subsequently, the CPU 1 converts at step S306 the minimum values BTM 1 and BTM 2 into an absolute value respectively in the same manner as the processing at step S36 to set each key-code of the absolute values and selects at step S307 a key-code (a lower key-code in the same interval) near to the bottom-tone BTMKC of the previous additional tone from the minimum values BTM 1 and BTM 2. Thus, the CPU 1 sets the number "i" of the selected key-code and causes the program to proceed to step S308.

When the program proceeds to step S308, the CPU 1 reads out each data of additional tones 1 and 2 of the selected number "i" from the voicing table for the two-tone pair in accordance with the type of the chord TP and the tone pitch difference D and sets the data of the additional tone 1 as key-codes $AD_1$ (j) (j=0 to the number of additional tones– 1) and sets the data of the additional tone 2 as key-codes $AD_2$ (j) in sequence. At the following step S309, the CPU 1 adds the additional tone data $AD_1$ (j) to the previous top-note TPKC1 and sets the data of the additional tone I as a key-code $AD_1$ (j). In this instance, the CPU 1 adds the additional tone data $AD_2$ (j) to the following top-note TPKC2 and sets the data of the additional tone 2 as a key-code $AD_2$ (j). Thus, the four additional tones each are determined as a two-tone pair in the flow of a backing tone of the two-tone pair. Subsequently, the CPU 1 sets at step S310 a minimum value of the key-code $AD_2$ (j) of the latter additional tone 2 as a key-code BTMKC of an additional tone for a previous bottom tone in the following processing and causes the program to proceed to step S311.

With the processing described above, a set of additional tones corresponding with the two-tone pair of the top-note or a set of additional tones corresponding with the one-tone of the top-note is produced. When the additional tones of the two-tone pair have been produced, a key-code of a previous additional tone is set as a key-code $AD_1$ (j), and a key-code of the following additional tone is set as a key-code $AD_2$ (j). When the additional tones of the one-tone have been produced, the key-codes of the additional tones are set as a key-cede $AD_1$ (j). In addition, a key-code of the bottom tone of a previous additional tone in the following processing is set as a key-code BTMKC.

Figure 16:
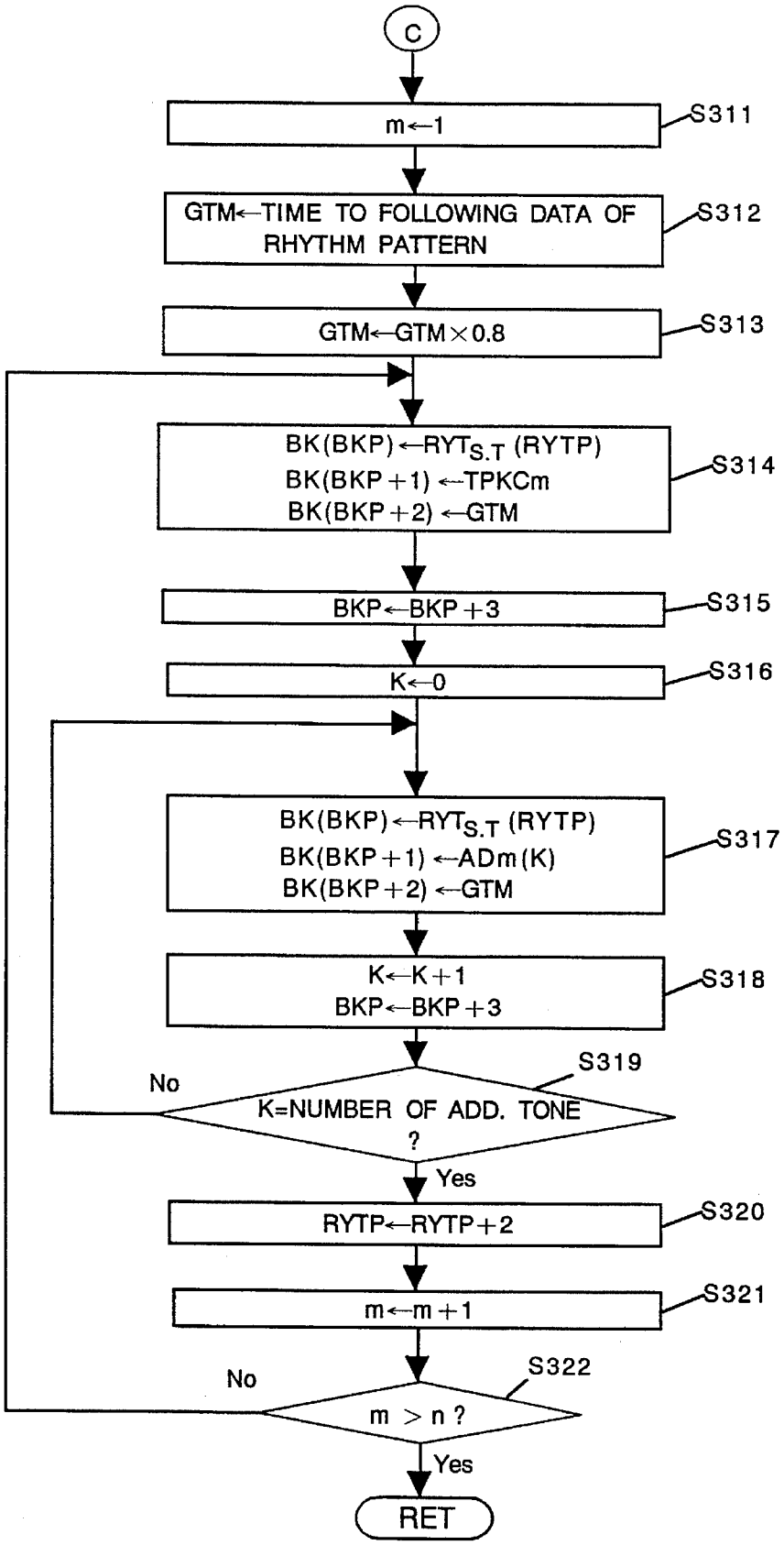
FIG. 16 is a flow chart illustrating a remaining portion of the voicing routine.

When the program proceeds to step S311 shown in FIG. 16, the CPU 1 sets "m" as "1" and causes the program to proceed to step S312 where the CPU 1 sets a time to the following data of the rhythm pattern as a gate time GTM of the rhythm pattern. Subsequently, the CPU 1 multiplies at step S313 the gate time GTM by 0.8 and sets a resultant of the multiplication as a gate time GTM of the backing part for processing at the following step.

At step S314, the CPU 1 memorizes a timing $RYT_{S,T}$ (RYTP), a key-code TPKCm of the top-note and the gate time GTM respectively in the registers BK(BKP), BK(BKP+1) and BK(BKP+2) of the backing part memory 6. Subsequently, the CPU 1 adds "3" to the writing pointer BKP of backing part memory 6 at step 315 and resets the counter K at step S316. At the following step S317, the CPU memorizes a timing $RYT_{S,T}$ (RYTP), an additional tone ADm(K) and the gate time GTM respectively in the registers BK(BKP), BK(BKP+1) and BK(BKP+2) and causes the program to proceed to step S318 where the CPU 1 adds "1" to the counter K and adds "3" to the writing pointer BKP of backing part memory 6. When the program proceeds to step S319, the CPU 1 determines whether the count value of the counter K has become "9" or not. If the answer at step S319 is "No", the program returns to step S317. If the answer at step S319 is "Yes", the program proceeds to step S320 where the CPU 1 adds "2" to the pointer RYTP of rhythm pattern memory 12. Subsequently, the CPU 1 adds "1" to "m" at step S321 and determines at step S322 whether "m" is larger than "n" or not. If processing of the following tone of the two-tone pair is remained, the CPU 1 determines a "No" answer at step S322 and returns the program to step S314. If processing of the following tone of the one-tone or the two-tone pair has finished, the CPU 1 determines a "Yes" answer at step S322 and returns the program to the main routine.

With the processing described above, a set of the top-note of the one-tone and the additional tone of the one-tone or a set of the top-note of the two-tone pair and the additional tone of the two-tone pair is produced at the timing of the note code of rhythm pattern memory 12 and memorized with the gate time in the backing part memory 6. The processing is conducted at step S18 and S19 of the backing part production routine for each measure in response to the note code at a timing of rhythm pattern memory 12. After finish of the backing part production, the top note and additional tones are produced in accordance with each measure and each type of the musical sentence for the whole musical tune.

Figure 17:
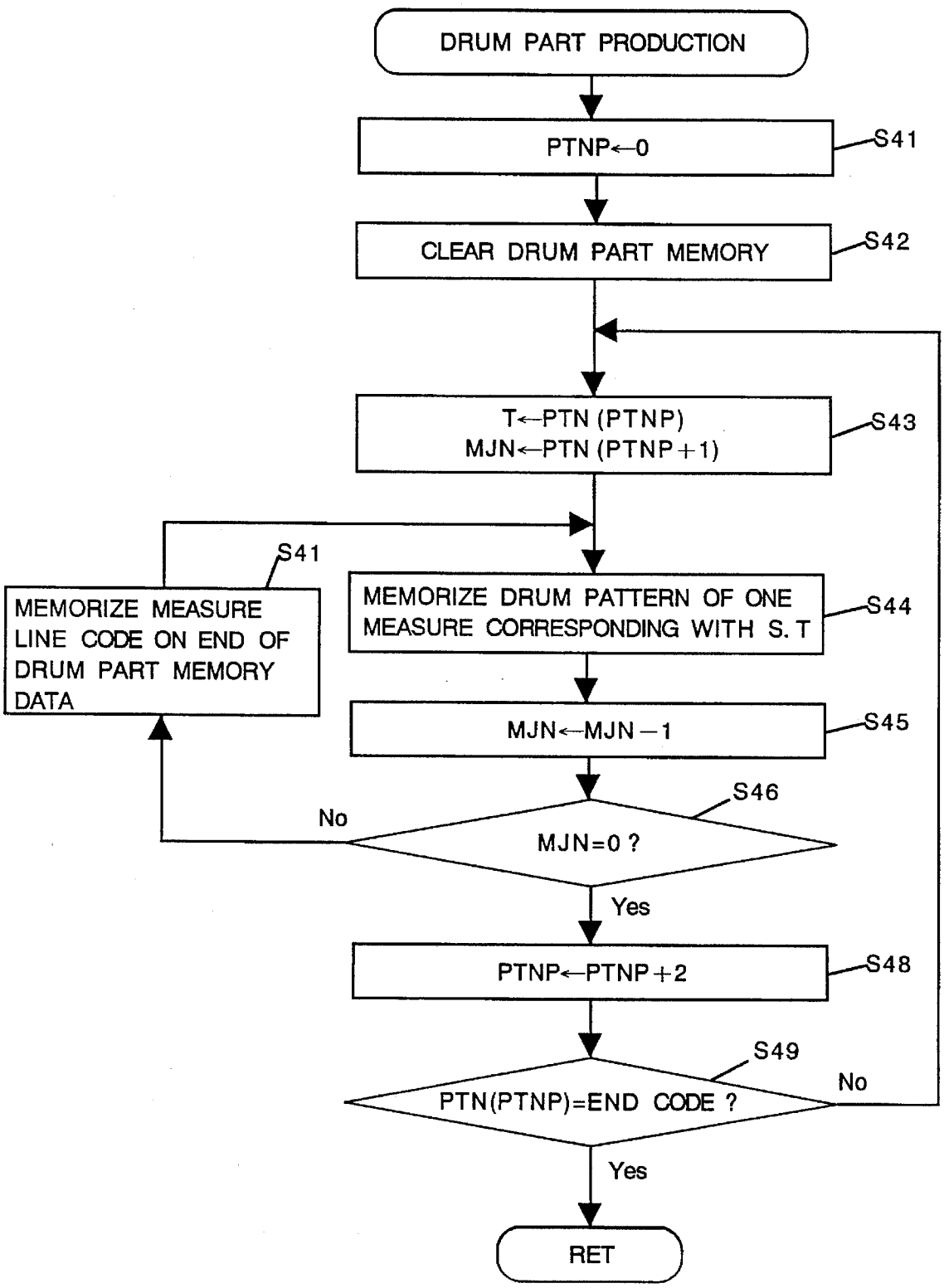
FIG. 17 is a flow chart of a drum part production routine.

During execution of the drum part production routine shown in FIG. 17, the CPU 1 resets the pointer PTNP of the pattern sequence memory at step S41 and makes the drum part memory 8 clear at step S42. At the following step S43, the CPU 1 memorizes the type number T of the musical sentence in the register PTN(PTNP) of the pattern sequence memory and memorizes the number MJN of measures of the type number T in the register PTN(PTNP+1) of the pattern sequence memory and renews the type number T of the musical sentence and the number MJN of measures until the end code of the pattern sequence memory is detected at step S49. Thus, the CPU 1 repeats processing at step S44 to S49 for each musical sentence as described below.

At step S44, the CPU 1 memorizes a drum pattern of one measure corresponding with the style number S and the type number T of the musical sentence in the drum part memory 8 and causes the program to proceed to step S45 where the CPU 1 subtracts "1" from the number MJN of measures. At the following step S46, the CPU 1 determines whether the number MJN of measures is "0" or not. If the answer at step S46 is "No", the program proceeds to step S47 where the CPU 1 writes a measure line code on the terminal end of the drum part memory data and returns the program to step S44. If the answer at step S46 is "Yes", the program proceeds to step S48 where the CPU 1 adds "2" to the read-out pointer PTNP of the pattern sequence memory. Thereafter, the CPU 1 repeats the processing at step S43 to S48 for each musical sentence until the end code is detected at step S49 and returns the program to the main routine after finish of the processing.

With the processing described above, a drum pattern of one measure corresponding with each type of musical sentences is repeatedly memorized by the number of measures of the respective musical sentences, and the measure line code is recorded between the respective measures.

Figure 18:
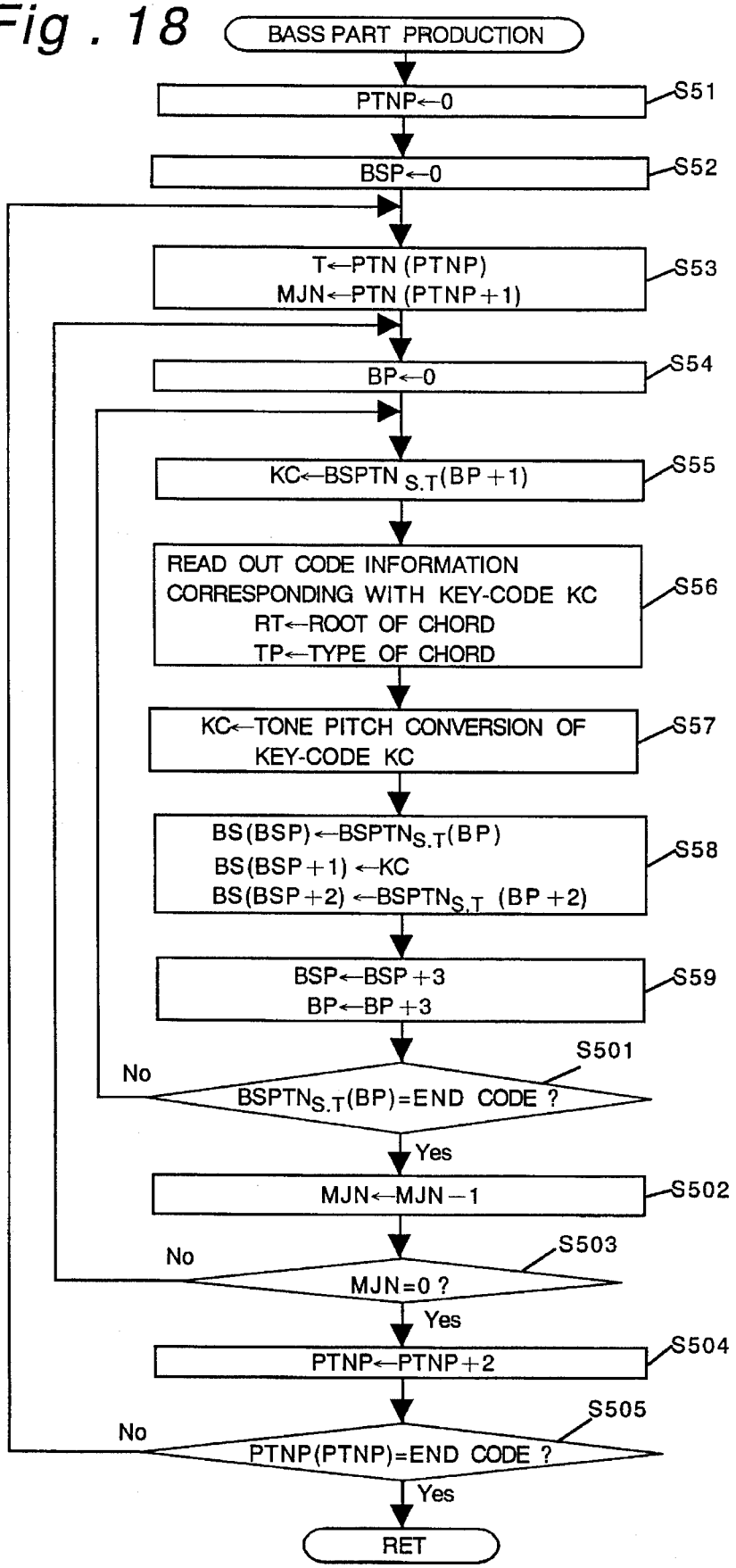
FIG. 18 is a flow chart of a bass part production routine.

During execution of the bass part production routine shown in FIG. 18, 1he CPU 1 resets at step S51 the read-out pointer PTNP of the pattern sequence memory and resets at step S52 the writing pointer BSP of bass part memory 7. At the following step S53, the CPU 1 memorizes the musical sentence type number T and the number of measures MJN respectively in the registers PTN (PTNP) and PTN (PTNP+1) of the pattern sequence memory and renews the musical type number T and the number of measures MJN for processing at step S54 to S503 until an end code of the pattern sequence memory is detected by processing at step S505.

At step S54, the CPU 1 resets the rear-out pointer BP of the bass pattern memory 7 for execution of processing for one measure at the following step S55 to S501. At each processing for one measure, the CPU 1 memorizes at step S55 a key-code KC of the bass part in the register $BSPTN_{S,T}$ (BP+1) of bass pattern memory 13 and reads out at step S56 a chord data corresponding with the key-code KC from the chord progression memory 5 to memorize the root and the type of the chord RT, PT. At the following step S57, the CPU 1 converts in tone pitch the key-code KC in accordance with the root and the type of the chord RT, TP and memorizes the converted key-code KC. Subsequently, the CPU 1 memorizes at step S58 a timing $BSPTN_{S,T}$, the key-code KC and a key-on time $BSTPN_{S,T}$(BP+2) respectively in the registers BS(BSP), BS(BSP+1) and BS(BSP+2) of bass part memory 7 and adds "3" to the writing pointer BSP and readout pointer BP of bass pattern memory 7 respectively. Thus, the CPU 1 determines at step S501 whether the data of $BSPTN_{S,T}$ (BP) is an end code or not.

If the answer at step S501 is "No", the CPU 1 returns the program to step S55 to continue processing of the one measure. If the answer at step S501 is "Yes", the program proceeds to step S502 where the CPU 1 subtracts "1" from the number MJN of measures. Subsequently, the CPU 1 determines at step S503 whether the number MJN of measures is "0" or not. If the answer at step S503 is "No", the CPU 1 returns the program to step S54. If the answer at step S503 is "Yes", the CPU 1 terminates processing of the respective measures of the musical sentence and repeats the same processing for each of the musical sentences as that for the previous musical sentence. Thereafter, the CPU 1 returns the program to the main routine when detected the end code of the pattern sequence memory at step S505.

With the processing described above, performance data of each the backing part, bass part and drum part is produced in the backing part memory 6, bass part memory 7 and drum part memory 8. In addition, finally performance data of a plurality of parts for one musical tune may be output in an appropriate form.

Although in the above embodiment the tone pitch of the top-note and additional tone has been determined on a basis of the melody and the chord data to produce performance data suitable for the chord, the tone pitch may be determined on a basis of only the chord. Although an available tone pitch is limited in an extent by the chord and melody, the above embodiment is designed to select the continuous tone pitch of the two-tone pair so that the previous tone of the two tones is adapted as an ornament tone. Accordingly, a selectable tone pitch increases more than that in the case where a tone pitch is independently selected for each one-tone. This useful to obtain more natural performance data.

In the above embodiment, the top-note is adapted to effect a counter line or melody. Thus, the production of the top-note can be utilized as a production method of counter melody.

In addition, when the same continuous tone has been selected as the top-note of -the two-tone pair, an additional tone of different tone pitch at its preceding and following tones may be selected as the additional tone. In this case, it is preferable to memorize the tone pitch of the additional tone in an appropriate table for selecting the tone pitch therefrom.

What is claimed is:

1. An automatic arrangement apparatus comprising:

input means for applying arrangement data for arrangement of an original musical tune to a processing system of the arrangement apparatus, the arrangement data including at least musical style data and chord progression data;

memory means for memorizing a plurality of rhythm patterns which correspond with at least the musical style data, the rhythm patterns each representing only tone generating timing;

selection means for selecting a desired rhythm pattern for arrangement of the original musical tune from the memorized rhythm patterns in accordance with the musical style data applied thereto;

tone pitch data meads for supplying tone pitch data indicative of an available pitch for the original musical tune on basis of the chord progression data;

means for reading out the selected rhythm pattern from said memory means; and means for producing performance data based on the tone generation timing of the selected rhythm pattern and the tone pitch data.

2. An automatic arrangement apparatus as claimed in claim 1, wherein the pitch name data means comprises:

first means for producing first tone pitch data corresponding to a first-named part of the original musical tune based on the chord progression data; and second means for producing second tone pitch data corresponding to a second-named part of the original musical tune based on the first pitch name data and the chord progression data.

3. An automatic arrangement apparatus as set forth in claim 2, wherein the first-named part of the original musical tune is a top-note part, and the second-named part is an additional tone applied to the top-note.

4. An automatic arrangement apparatus comprising:

first memory means for memorizing a rhythm pattern indicative only of tone generation timing in an original musical tune;

supply means for supplying tone pitch information in the original musical tune based on chord progression data;

second memory means for memorizing in sequence a plurality of informations each indicative of continuous tone pitch shorter than the rhythm pattern;

selection means for selecting a set of continuous tone pitch informations from the memorized informations; and means arranged to be applied with the tone generation timing of the rhythm pattern, the tone pitch information and the selected set of continuous tone pitch informations respectively from said first memory means, said supply means and said second memory means for producing a performance information corresponding with the tone generation timing on a basis of the tone generation timing, the tone pitch information and the selected set of continuous tone pitch informations.

* * * * *